US005703321A

United States Patent [19]

Feierlein et al.

[11] Patent Number: 5,703,321

[45] Date of Patent: Dec. 30, 1997

[54] DEVICE FOR LOCATING ARTILLERY AND SNIPER POSITIONS

[75] Inventors: Johannes Feierlein, Oberpframmern; Ulrich Rieger, Feldkirchen-Westerham, both of Germany

[73] Assignee: Daimler-Benz Aerospace AG, München, Germany

[21] Appl. No.: 546,809

[22] Filed: Oct. 23, 1995

[30] Foreign Application Priority Data

Nov. 8, 1994 [DE] Germany ..... 44 39 850.6

[51] Int. Cl.[6] ..... F41B 33/04

[52] U.S. Cl. ..... 102/427; 89/1.11; 89/41.08

[58] Field of Search ..... 89/41.08, 1.11; 102/427, 424

[56] References Cited

U.S. PATENT DOCUMENTS

| | | | |
|---|---|---|---|
| H1441 | 6/1995 | Kosingki | 102/427 |
| 4,408,533 | 10/1983 | Owen et al. | 102/427 |
| 4,919,051 | 4/1990 | Cohen | 102/427 |
| 5,153,372 | 10/1992 | Deuss et al. | 102/427 |

*Primary Examiner*—Stephen M. Johnson
*Attorney, Agent, or Firm*—McGlew and Tuttle

[57] ABSTRACT

A device for locating artillery and sniper fire with a sensor and acoustically triggered marking means. An igniter is provided with the acoustic sensor and is adjustable in terms of frequency and/or pulse pattern. A remover preventer is provided and the components are provided in a shell-proof housing whereby removal triggers the marking means.

9 Claims, 1 Drawing Sheet

Fig.1
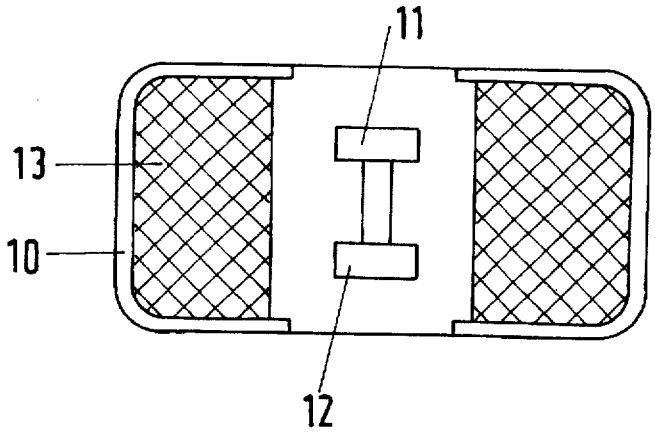
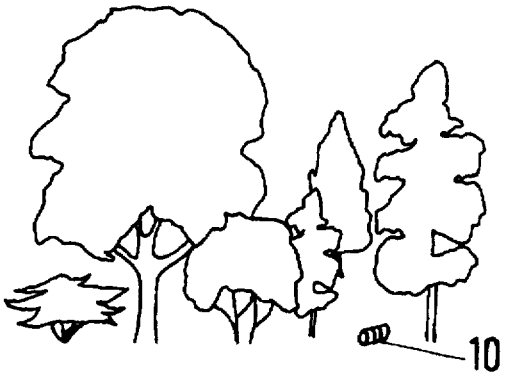
Fig.2a
Fig.2b
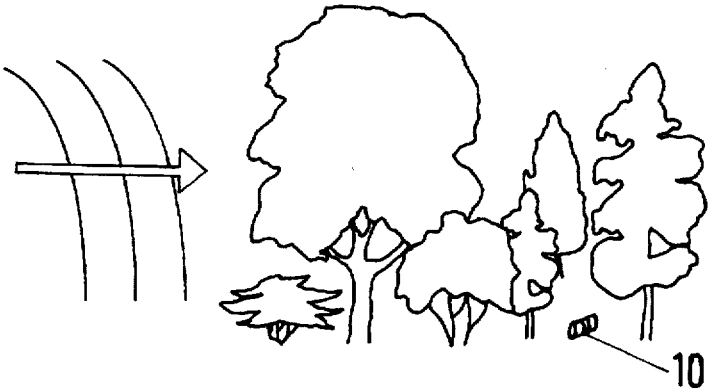
Fig.2c
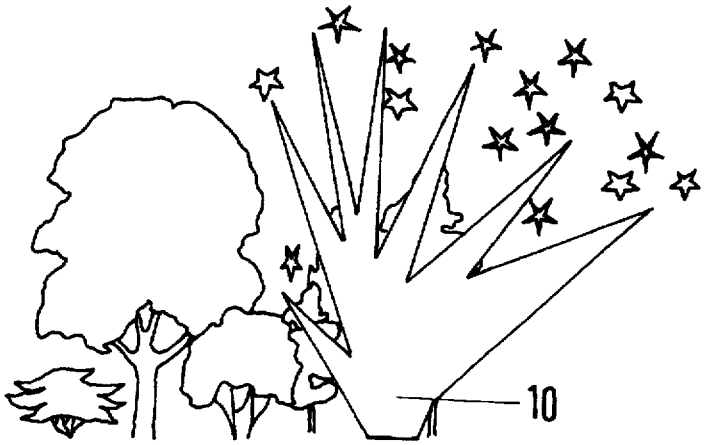

DEVICE FOR LOCATING ARTILLERY AND SNIPER POSITIONS

FIELD OF THE INVENTION

The present invention pertains to a device for locating artillery and sniper positions during the firing of a shot by sensors operating as a triggering mechanism for signalling.

BACKGROUND OF THE INVENTION

As is currently known, artillery and sniper weapons are frequently used nonspecifically against civilian targets, and therefore they represent a terrorist potential, whose "drying up" is a priority in peace-keeping missions. As was demonstrated by the recent past, the problems linked with the location especially of light and medium artillery weapons, such as mortars, etc., have yet to be solved.

Artillery positions are fought, in general, by measuring the firing guns with acoustic sensors, etc., and subsequently firing on them. Furthermore, a modem measuring instrument of high accuracy is available in the form of an artillery observation radar system. The firing is carried out, in general, with artillery shells, guided missiles, drop bombs, etc. These combat means have a lethal effect without exception, and they basically go beyond the scope of self defense, especially for so-called "peace-keeping units," such as the U.N. units. Such units are therefore consistently required to have a very high deployment threshold. Because of the great prevailing time intervals between terrorist artillery deployment, etc., and the need for combat measures and finally their use, these measures may sometimes be directed against the wrong targets, and then they will considerably contribute to the escalation of the conflict or the start up of another conflict.

In DE 42 28 539 A1, the applicant proposed a complicated multisensor system for the recognition and the identification of weapons and combat situations, which is much too expensive for deployment against terrorism.

The circumstances are different in the case of snipers; they can be fought only individually in the short range, and they have at any time the possibility of escaping the action of the peace-keeping units, e.g., by disappearing among the civilian population.

A large number of devices for locating and protecting objects have been known from the state of the art; e.g., an open-ground monitoring system using acoustic pick-ups has been known from DE 29 00 444, or an alarm device operating without installation has been known from DE 35 04 552. However, all these object protection devices are only poorly suitable or completely unsuitable for a variable use for controlling terrorist actions.

SUMMARY AND OBJECT OF THE INVENTION

The primary object of the present invention is to provide a deployment means which can be used both to support the combating of artillery and to combat snipers, which is generally readily and rapidly available, and which guarantees location in all cases.

According to the invention, a device is provided for locating artillery and sniper positions during the firing of a shot from one or more positions. An acoustic sensor is employed as a triggering mechanism. An igniter is provided for signalling. The igniter is coupled to an acoustic sensor. The acoustic sensor is adjustable in terms of frequency and/or pulse pattern. The acoustic sensor is disposed in a shell-proof housing and is connected to removal preventer means for preventing removal. The removal preventer means preferably triggers the igniter upon tampering or otherwise disturbing the housing and/or triggering mechanism. The igniter as well as the other components are in functional connection with an optical signalling means which is disposed in the housing. The igniter acts to release the optical signalling means upon actuation by the acoustic sensor.

The acoustic sensor preferably includes programming means for detecting a particular signature. The acoustic sensor is preferably designed as an adjustable acoustic sensor, adjustable to a threshold value-limited frequency spectrum in a caliber-specific manner.

The signalling means can be a combination of various different pyrotechnic components to provide an unambiguous optical coding, by providing different colors or different color combinations. Preferably, the signalling means is designed as light flares with a corresponding blasting cup or as a "Greek fire" (an incendiary composition, any of several flammable mixtures).

According to the invention, the removal prevention means is preferably designed as a mercury switch. With this arrangement, any attempt to remove the device or more particularly to tamper with or to remove the igniter leads to ignition and to deployment of the optical signalling means.

Preferably, the device is either deployed in advance, at locations around a compound or position or, in the alternative, the device is employed using components for arrangement on dispensers and guided missiles or is designed for deployment with rifle grenade firing means or the like.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a cross sectional view of an embodiment of the marking device according to the present invention for locating artillery and snipers; and FIGS. 2*a* through 2*c* show diagrams illustrating the function of the marking device according to the present invention.

DETAILED DESCRIPTION OF THE PREFERRED EMBODIMENT

Referring to the drawings in particular the present invention comprises placing a specially designed marking means either preventively in places suitable for artillery or sniper positions or to bring them with deploying means to already occupied, reconnoitered positions. Such deploying means depend, of course, on the deployment in question. These may be, e.g., mobile dispensers, guided missiles or mine-laying systems for artillery positions, or so-called rifle grenades for sniper positions in already occupied positions.

The device for locating artillery and snipers is composed of an extensively shell-proof container 10 of small volume, about 0.5 to 1 L, with the following components:

a) an igniter 11 equipped with an acoustic triggering sensor, wherein the sensor can be set to the shot noise signature of the guns, mortars, machine guns or ordinary ammunition to be fought, using the signature acoustic pattern as it occurs in an area with a distance of less than 100 m in the case of so-called "heavy artillery." In addition, the igniter is provided with a so-called removal preventer 12, which automatically triggers the signaling means 13 when removal, evacuation or shelling is attempted. This removal preventer may be, e.g., a simple mercury switch.

b) a pyrotechnic signaling means, which is visible beyond the limits of built-in and overgrown areas and is also active for a certain time, e.g., 15–30 sec. It may be light flares with the corresponding blasting cup or so-called "Greek fire."

As can be seen in FIG. 1, the device preferably provides the extensively shell-proof container 10 with optical signalling means 13 disposed therein. The igniter 11 is disposed preferably connected with the removal preventer means which is in functional connection with the igniter for setting off the igniter automatically or for automatically triggering the signalling means 13 upon attempts to remove the device or remove the acoustic sensor or attempts to evacuate the device or shell the device. With this small volume device as shown in FIG. 1, the device may be disposed as shown in FIGS. 2A, 2B and 2C. FIG. 2A shows the device in a deployed position. FIG. 2B shows an acoustic wave approaching the position. Assuming that the acoustic wave is in a frequency range set for the igniter 11, the optical display is deployed as is shown in FIG. 2C.

The above-described device for locating the guns or rifles in question to be monitored and its signaling means for marking same is triggered when one or more shots are fired in the detection area of the sensor 11. However, it is not triggered when the signature of a detected shot does not correspond to the stored signature (pulse pattern, frequency spectrum, etc.).

The stored signature may be variably programmable in one embodiment; it may be preset by selection from igniters set differently in a second embodiment; and it may be a wide-band signature with threshold values in a third embodiment. Thus, it is possible to set only an evaluation of low-frequency components for detecting large calibers, or the evaluation of high frequencies for detecting rifle fire.

The optical marking by a pyrotechnical signaling means, which is visible from over great distances, enables even a smaller observation troop to monitor a large area, to directly locate snipers or artillery, etc., to correctly assign combating means, as well as to document the result of the observation.

Other variations are possible; it is possible, e.g., to additionally obtain a coding system by different shaping of the pyrotechnic signaling means, e.g., by different or combined colors, in the case of individual placement at a gun, even in the course of a checking of heavy artillery. For example, satisfactory distinction of guns of one party from those of the other party is guaranteed.

In the case of deployment over inaccessible or defended positions by means of carrier shells or missiles, destruction of the carrier in question at a sufficient altitude above the position to be monitored is necessary. This can be achieved by means of conventional proximity fuses based on radar or laser in the carrier itself.

While specific embodiments of the invention have been shown and described in detail to illustrate the application of the principles of the invention, it will be understood that the invention may be embodied otherwise without departing from such principles.

What is claimed is:

1. A device for locating artillery and sniper positions during the firing of a shot, comprising: acoustic sensor triggering means including an igniter with an acoustic sensor, said acoustic sensor being adjustable in terms of at least one of frequency and pulse pattern; a shell-proof housing, said acoustic sensor triggering means being disposed in said housing; removal preventer means connected to said acoustic sensor triggering means; and optical signalling means in functional connection with said triggering means and said removal preventer and deposited within said housing, said optical signalling means being released upon ignition by said igniter.

2. A device according to claim 1, wherein said acoustic sensor is programmable for detecting an acoustic signature.

3. A device according to claim 1, wherein said acoustic sensor is adjustable to a threshold value-limited frequency spectrum corresponding to a caliber-specific frequency spectrum.

4. A device according to claim 1, wherein said optical signalling means comprises one or more pyrotechnic components to provide an different optical color displays or combinations of colors.

5. A device according to claim 1, wherein said signalling means is one of light flares, blasting cap and Greek fire.

6. A device according to claim 1, wherein said removal preventer means includes a mercury switch.

7. A process for locating artillery and sniper positions during the firing of a shot, comprising the steps of:

deploying a device including an acoustic sensor, an igniter and an optical signalling means;

actuating the igniter for deploying the optical signalling means upon sensing an acoustic signal within a predetermined frequency or pulse pattern; and actuating the igniter to deploy the optical signalling means upon any attempt to remove the acoustic sensor.

8. A device according to claim 7, further comprising varying one of said frequency or pulse pattern to change a threshold value-limited frequency spectrum or pulse pattern to correspond with a specific caliber of munitions.

9. A method according to claim 7, further comprising programming said acoustic sensor to detect an acoustic signature.

* * * * *